US012751563B1

(12) United States Patent
Chen

(10) Patent No.: US 12,751,563 B1
(45) Date of Patent: Oct. 6, 2026

(54) CRADLE AND ITS INTELLIGENT SENSING AND SOOTHING DEVICE

(71) Applicant: Way-Hong Chen, Taipei City (TW)

(72) Inventor: Way-Hong Chen, Taipei City (TW)

( * ) Notice: Subject to any disclaimer, the term of this patent is extended or adjusted under 35 U.S.C. 154(b) by 0 days.

(21) Appl. No.: 19/276,418

(22) Filed: Jul. 22, 2025

(51) Int. Cl.
*A47D 9/02* (2006.01)
*A47D 15/00* (2006.01)

(52) U.S. Cl.
CPC ..... *A47D 9/057* (2022.08); *A47D 15/00* (2013.01)

(58) Field of Classification Search
CPC ..... A47D 9/057; A47D 9/02; A47D 15/00; G08B 21/0208; G08B 21/0288; G08B 21/0227; A63H 33/006
See application file for complete search history.

(56) References Cited

U.S. PATENT DOCUMENTS 1,428,961 A * 9/1922 Hudoba ..... A47D 9/02 5/109
7,685,657 B1 * 3/2010 Hernandez ..... A47D 9/057 5/101
2016/0074764 A1 * 3/2016 Chen ..... A63H 33/006 446/227
2018/0035082 A1 * 2/2018 Patil ..... A47D 15/00
2019/0130720 A1 * 5/2019 Lui ..... G06V 10/82
2021/0085096 A1 * 3/2021 Juchniewicz ..... A61B 5/6891
2021/0369001 A1 * 12/2021 Chen ..... H02K 7/14
2023/0017121 A1 * 1/2023 Liao ..... A47D 9/057
2023/0102445 A1 * 3/2023 Griffith ..... H04N 23/54 348/151

FOREIGN PATENT DOCUMENTS

CN 112598874 A * 4/2021 ..... G08B 21/0288

* cited by examiner

*Primary Examiner* — Matthew Troutman
*Assistant Examiner* — Alison N Labarge
(74) *Attorney, Agent, or Firm* — LANWAY IPR SERVICES; Chun-Ming Shih

(57) ABSTRACT

A cradle with an intelligent sensing and soothing device includes a bed base unit and a movable bed unit assembled on the bed base unit. The movable bed unit is slidable and capable of rocking relative to the bed base unit. The movable bed unit is provided with a main unit having sound and light generating functions. The main unit is provided with a sensing and control module for detecting sound, body temperature, and motion. Thus, when the sensing and control module senses or detects that the baby is in an abnormal state, such as crying, it activates the sound and light effects along with the rocking function to achieve a soothing effect for the baby.

4 Claims, 6 Drawing Sheets

CRADLE AND ITS INTELLIGENT SENSING AND SOOTHING DEVICE

BACKGROUND OF THE INVENTION

Field of the Invention

The present invention relates to a cradle for rocking a baby and, more particularly, to a cradle and its intelligent sensing and soothing device.

Description of the Related Art

Parents or caregivers often purchase and use a crib to confine an infant's range of movement and make care easier. An electromagnetic cradle with an automatic rocking function can further help soothe the infant. However, most existing cribs still require a person to manually activate the rocking function. The conventional cribs cannot start rocking automatically according to the infant's condition. In addition, relying solely on rocking may provide an inadequate soothing effect.

In view of the aforementioned shortcomings, the inventor recognized the necessity for improvement. Drawing upon years of experience in related technologies and product design and manufacturing, and adhering to principles of superior design, the inventor conducted extensive research and development to address the above issues. After continuous effort, the present invention, a cradle and its intelligent sensing and soothing device, was successfully developed, aiming to improve the product structure and enhance its overall performance and effectiveness.

BRIEF SUMMARY OF THE INVENTION

The primary objective of a cradle and its intelligent sensing and soothing device of the present invention is to provide an electromagnetic rocking bed capable of offering audiovisual soothing functions and automatically activating by sensing the baby's condition.

In accordance with the present invention, there is provided a cradle and its intelligent sensing and soothing device, comprising a bed base unit, a movable bed unit, a main unit, and a sensing and control unit. The bed base unit includes a base frame, and two guide rails fixedly mounted on the base frame. Each of the two guide rails has a top recessed with two guide rail sliding grooves. Each of the two guide rail sliding grooves is formed with a concave arc shape with its lowest point at a center thereof. Each of the two guide rail sliding grooves has interior provided with a steel ball. An electromagnetic generator is fixedly mounted on the base frame. The movable bed unit includes a bed body, and two sliding sleeves fixedly mounted on a bottom of the bed body. The two sliding sleeves are mounted on the two guide rails respectively. Multiple bearing seats and a magnet box are fixedly mounted on the bottom of the bed body. Each of the bearing seats has a bottom recessed with a bearing seat sliding groove. The bearing seat sliding groove rests against the steel ball. The magnet box is disposed above the electromagnetic generator. An enclosure is fixedly mounted on the bed body. The main unit includes a casing fixed to the enclosure. A camera is pivotally mounted to the casing. The camera is connected to an adjustment knob. The adjustment knob corresponds to a rotation axis of the camera. The casing is provided with a sound generator and a lighting unit. The sensing and control unit is mounted on in the casing and includes a main controller electrically connected to the camera, the sound generator, and the lighting unit. The main controller is electrically connected to an audio receiver, a body temperature sensing module, a motion sensing module, a cradle connection module, a connection module, and a control button set. The cradle connection module is electrically connected to the electromagnetic generator.

According to the primary advantages of the present invention, when the electromagnetic generator is energized, it generates a magnetic field that attracts or repels the magnet box, thereby driving the movable bed unit of the cradle to slide and rock along the two guide rails, in order to soothe the baby lying inside the bed body.

According to another advantage of the present invention, the audio receiver can detect a sound, and the main controller can determine whether the sound is a baby's cry. The body temperature sensing module is used to detect the temperature within the bed body, and the main controller can determine whether the baby has a fever or hypothermia. The motion sensing module detects movement of an object within the bed body and allows the main controller to determine whether the baby has performed actions such as turning over or raising hands, as well as to monitor the baby's breathing and heart rate. Therefore, when the main controller processes the sensed data and determines that the baby is in an abnormal state, it will activate the corresponding functions. For example, if the main controller determines that the baby is crying, the main unit will activate the audio-visual functions and, through the cradle connection module, start the electromagnetic generator to soothe the baby using the sound, light, and rocking motion. Alternatively, if the main controller detects that the baby is experiencing abnormal body temperature or is in a more dangerous condition such as the absence of breathing or heartbeat, the main unit will emit an alert sound to attract the caregiver's attention.

According to a further advantage of the present invention, the main controller can connect to a handheld device, such as a mobile phone or tablet, via the connection module, allowing various functions to be adjusted or turned on/off through the handheld device. Furthermore, when the main controller detects a change in the baby's condition or identifies any dangerous vital signs, it will also send an alert message to the handheld device via the connection module to notify the caregiver.

Compared to a conventional electromagnetic cradle that only provides a rocking function and must be manually activated, the cradle of the present invention can sense the baby's condition and automatically activate the rocking function. The cradle also integrates sound and light soothing features, thereby enhancing both ease of use and soothing efficiency. Thus, the cradle of the present invention is evidently a significantly improved and highly practical product.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
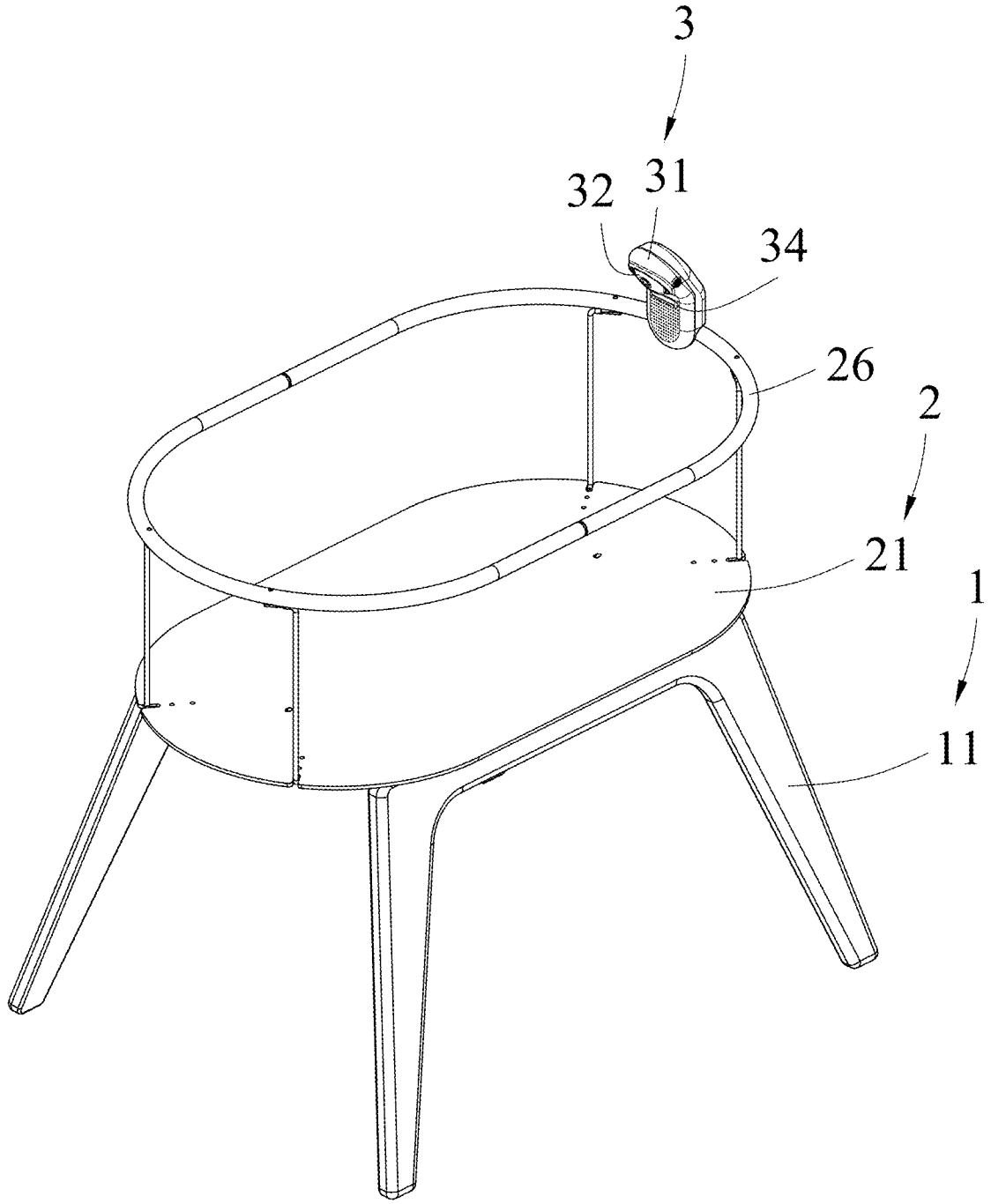
FIG. 1 is a perspective view of a cradle and its intelligent sensing and soothing device in accordance with the preferred embodiment of the present invention.
Figure 2:
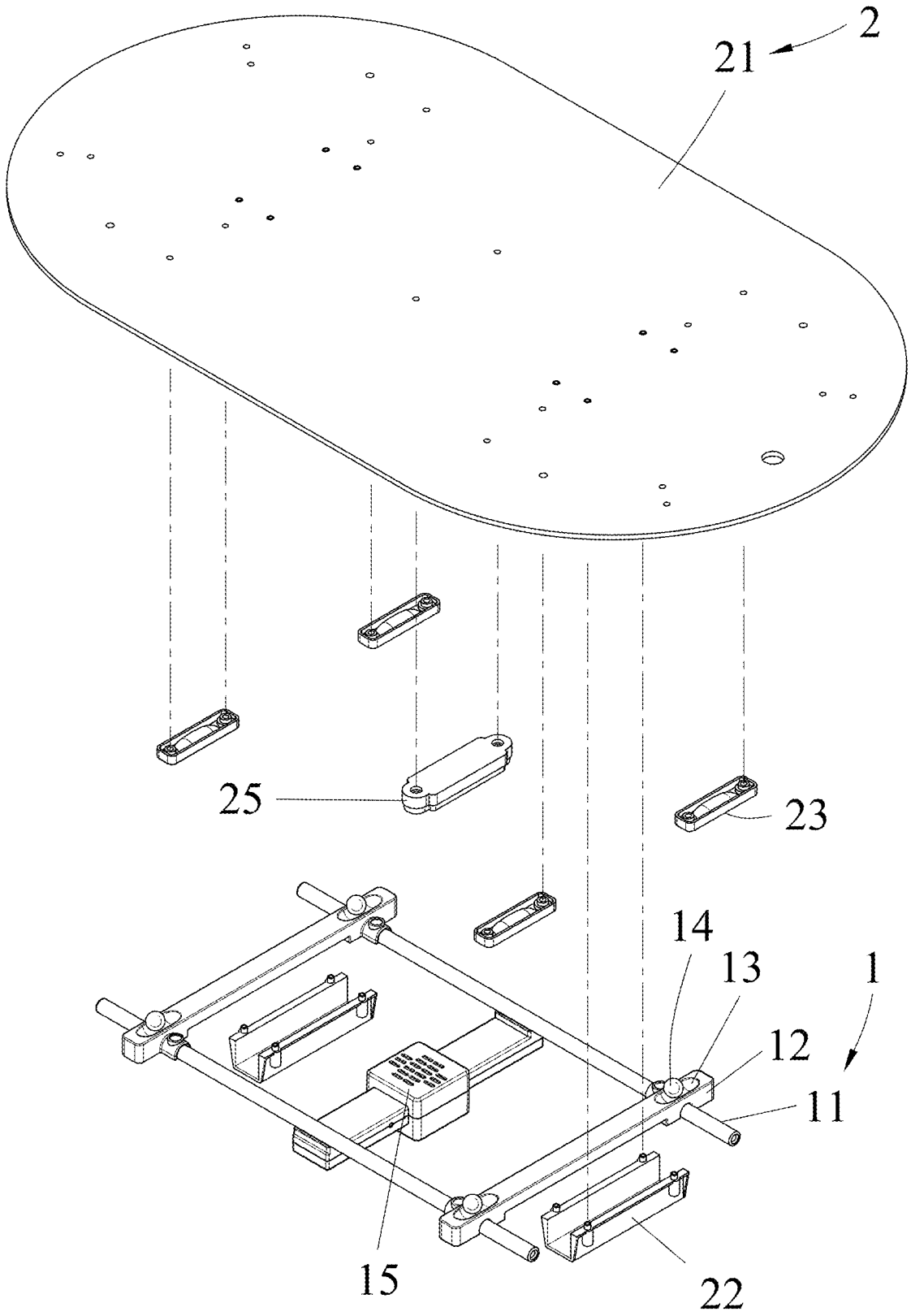
FIG. 2 is an exploded perspective view of the cradle and its intelligent sensing and soothing device of the present invention.
Figure 3:
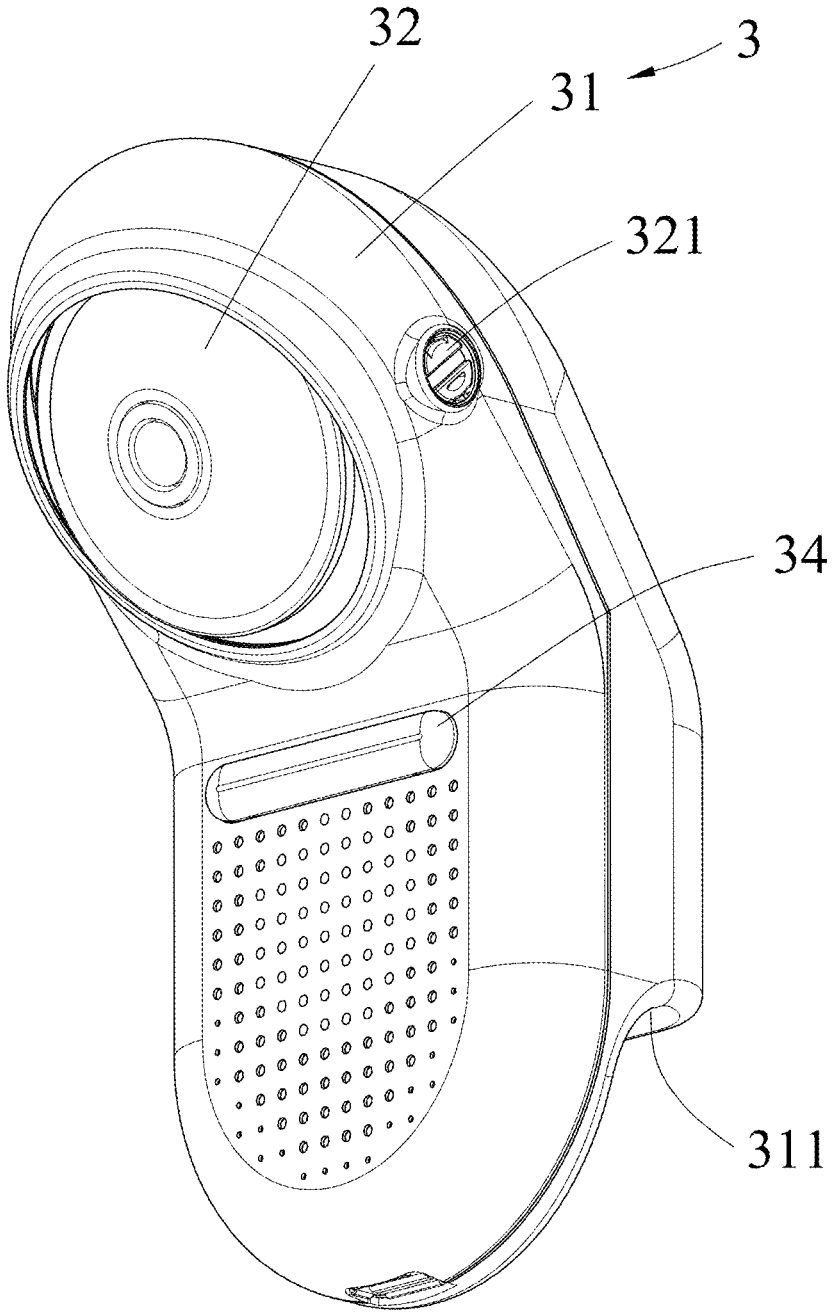
FIG. 3 is a perspective view of an intelligent sensing and soothing device of the cradle in accordance with the preferred embodiment of the present invention.
Figure 4:
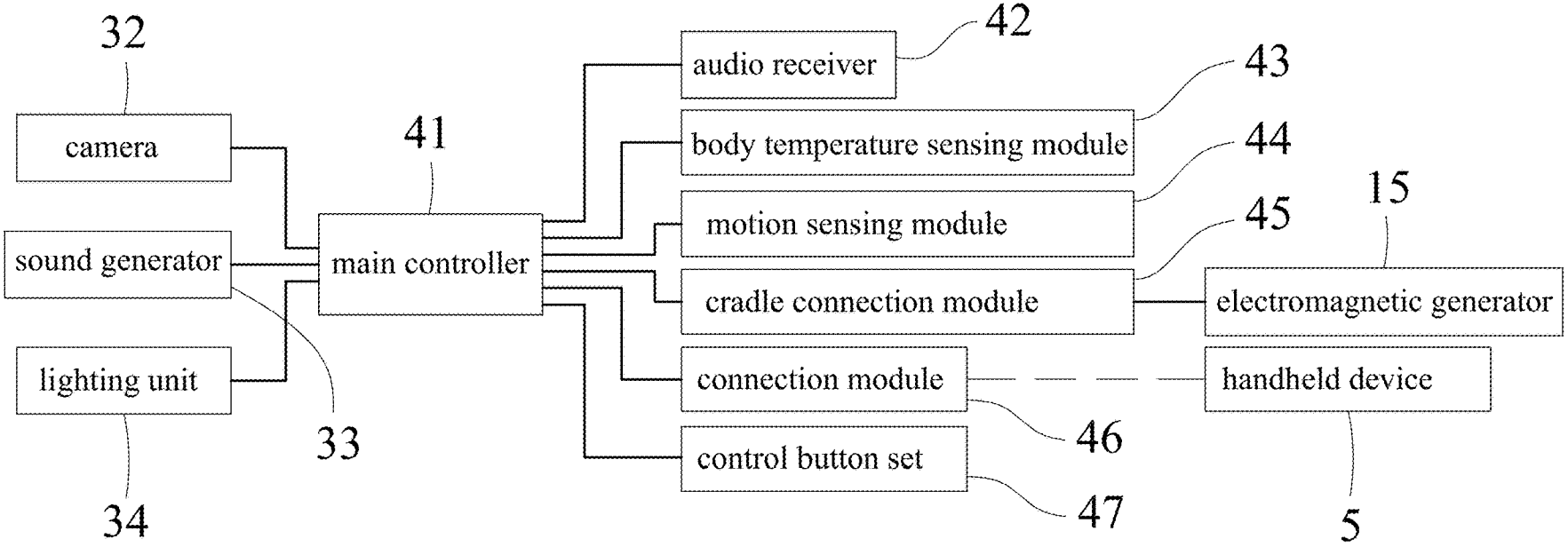
FIG. 4 is a block diagram of the electrical connections of the cradle and its intelligent sensing soothing device according to the present invention.
Figure 5:
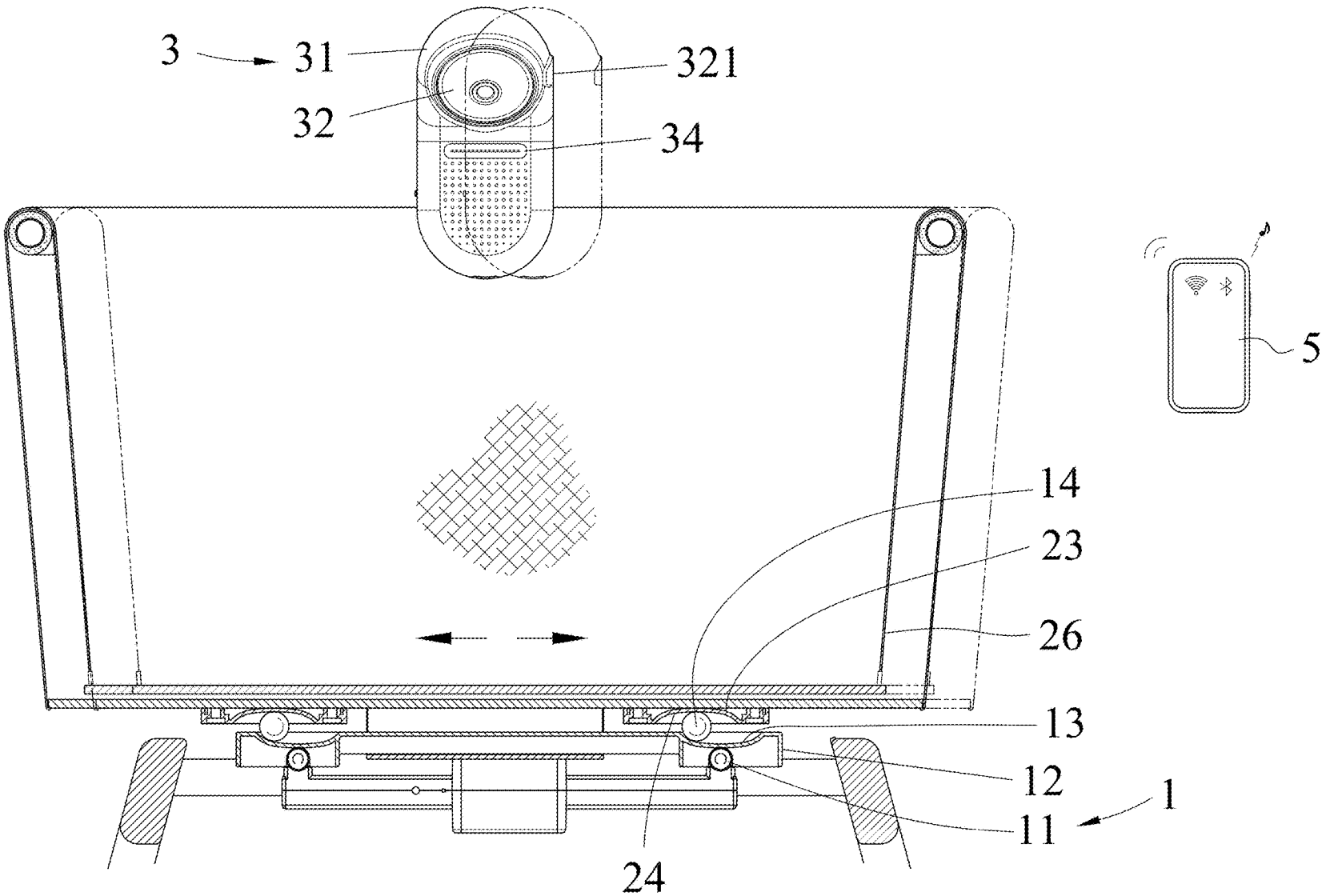
FIG. 5 is a schematic diagram illustrating the rocking operation of the cradle and its intelligent sensing soothing device according to the present invention.

Please refer to FIGS. 1 to 5. The present invention relates to a cradle and its intelligent sensing soothing device. The cradle comprises a bed base unit 1, a movable bed unit 2, a main unit (or host device) 3, and a sensing (or detecting) and control unit 4.

The bed base unit 1 includes a base frame 11, and two guide rails 12 fixedly mounted on the base frame 11. The two guide rails 12 are parallel with each other. Each of the two guide rails 12 has a top recessed with two guide rail sliding grooves 13. Each of the two guide rail sliding grooves 13 has interior provided with a steel ball 14. Each of the two guide rail sliding grooves 13 is formed with a concave arc shape with its lowest point at a center thereof. Therefore, after the steel ball 14 is displaced to another position in each of the two guide rail sliding grooves 13, the steel ball 14 tends to return to the lowest point of each of the two guide rail sliding grooves 13. An electromagnetic generator 15 is fixedly mounted on the base frame 11. The electromagnetic generator 15 generates a magnetic field when energized.

The movable bed unit 2 includes a bed body 21 for an infant to lie on, and two sliding sleeves 22 fixedly mounted on a bottom of the bed body 21. The two sliding sleeves 22 are mounted on the two guide rails 12 respectively, allowing the two sliding sleeves 22 to slide along the two guide rails 12. Four bearing seats 23 and a magnet box 25 are fixedly mounted on the bottom of the bed body 21. Each of the four bearing seats 23 has a bottom recessed with a bearing seat sliding groove 24. The bearing seat sliding groove 24 rests against the steel ball 14. The magnet box 25 contains multiple magnets installed within a box body. The magnet box 25 is disposed above the electromagnetic generator 15. An enclosure 26 is fixedly mounted on the bed body 21.

The main unit 3 includes a casing 31 recessed with a recessed portion 311. A camera 32 with an adjustable angle is pivotally mounted to the casing 31. The camera 32 is connected to an adjustment knob 321. The adjustment knob 321 corresponds to a rotation axis of the camera 32. Therefore, an angle of the camera 32 may be adjusted by rotating the adjustment knob 321. The casing 31 is provided with a sound generator 33 and a lighting unit 34. The casing 31 rests against the enclosure 26 by means of the recessed portion 311. The casing 31 is fixed to the enclosure 26.

The sensing and control unit 4 is mounted on in the casing 31 and includes a main controller 41 with functions of automatic control, analytical computation, and data storage. The main controller 41 is electrically connected to the camera 32, the sound generator 33, and the lighting unit 34. The main controller 41 is also electrically connected to an audio receiver 42, a body temperature sensing module 43, a motion sensing module 44, a cradle connection module 45, a connection module 46, and a control button set 47. The cradle connection module 45 is also electrically connected to the electromagnetic generator 15.

Please again refer to FIGS. 1 to 5. The casing 31 of the main unit 3 is fixed to the enclosure 26 using screws, clamps, or other known fastening methods. In a preferred dimensional embodiment, the camera 32 is positioned approximately 310 mm above a bed surface and is angled (or oriented) 40 degrees downward from a vertical line. An upward and downward rotation range of the camera 32 is designed to be 15 degrees. The cradle connection module 45 is used for electrical connection to the electromagnetic generator 15, allowing the main controller 41 to control the electromagnetic generator 15. For example, the cradle connection module 45 may include two USB ports and a USB cable inserted into the USB ports, with one of the two USB ports electrically connected to the electromagnetic generator 15 to establish the connection. The body temperature sensing module 43 may use a non-contact thermopile infrared sensor, while the motion sensing module 44 uses a millimeter-wave radar sensor. Additionally, a power supply for the main unit 3 and the sensing and control unit 4 can be provided either by a battery or by direct connection to mains electricity.

Figure 6:
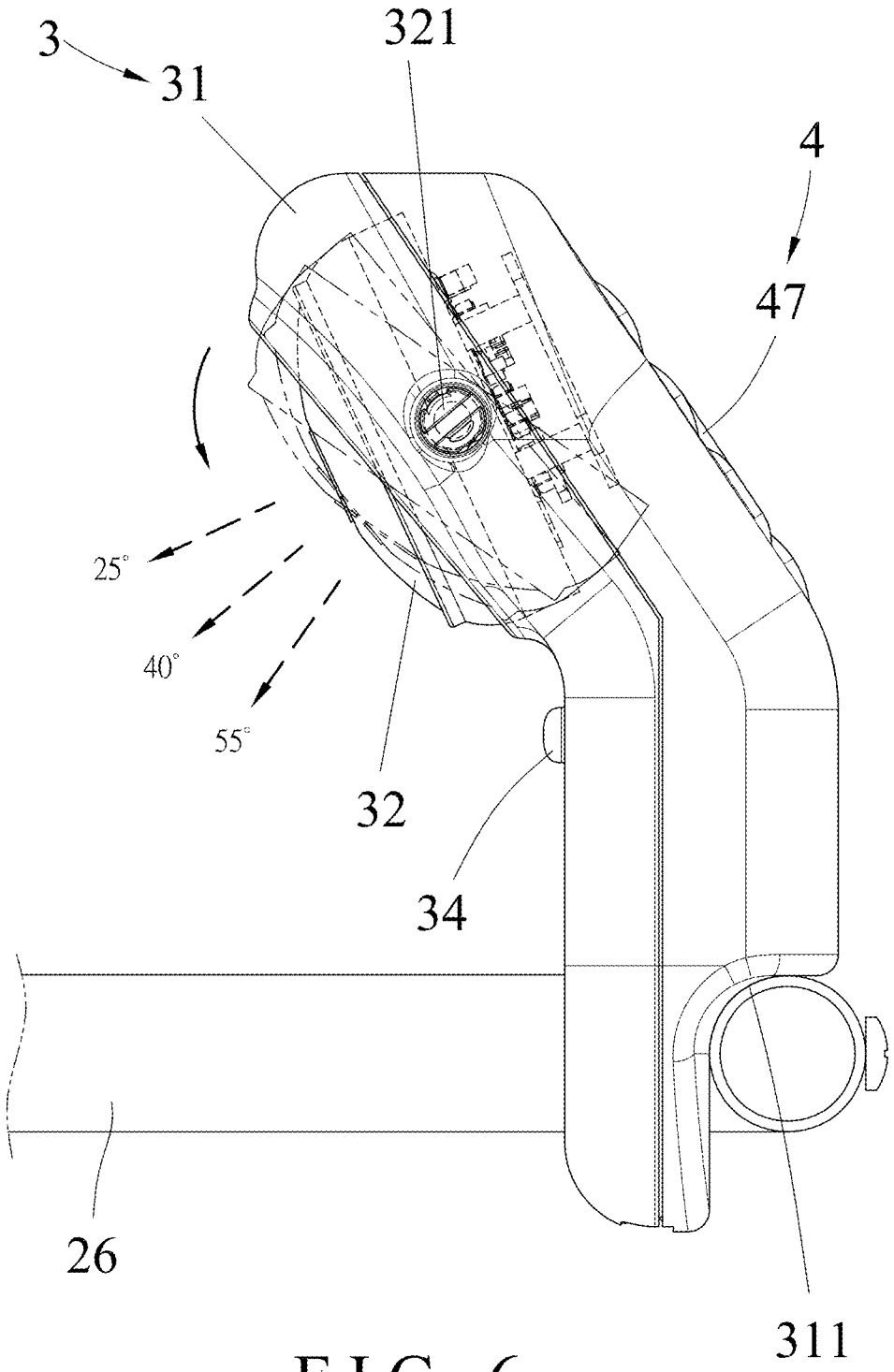
FIG. 6 is a schematic diagram illustrating the adjustment angle of the camera of the cradle and its intelligent sensing soothing device according to the present invention.

Please also refer to FIG. 6 with reference to FIGS. 1 to 5. In operation of the present invention, the electromagnetic generator 15 produces the magnetic field when powered on, and a direction of the magnetic field is changed at preset time intervals. Through attraction or repulsion of the electromagnetic generator 15 with the magnet box 25, the movable bed unit 2 is driven to slide back and forth along the two guide rails 12. When an infant is lying on the bed body 21 during movement of the movable bed unit 2, a soothing effect can be achieved. Additionally, since each of the two guide rail sliding grooves 13 is formed with a concave arc shape, the steel ball 14 will roll back to the lowest point of each of the two guide rail sliding grooves 13 when the electromagnetic generator 15 stops operating.

The audio receiver 42 of the present invention is used to detect sounds. A detected audio information (or data) is transmitted to the main controller 41 to determine whether it is a sound of crying. The body temperature sensing module 43 uses infrared sensing to detect a temperature within the bed body 21, and transmits a temperature information (or data) to the main controller 41 to determine whether the infant has a fever or is experiencing low body temperature. The motion sensing module 44 uses the millimeter-wave radar sensor to detect movement of objects within the bed body 21, and the main controller 41 determines whether the infant is making small or large movements, such as turning over or raising a hand. At the same time, the millimeter-wave radar sensor of the motion sensing module 44 also detects the infant's breathing and heartbeat rates. Therefore, when the main controller 41 determines that there is an abnormal condition in the infant's state, the main controller 41 activates preset response functions. For example, when the infant begins to cry, the main controller 41 will activate the sound generator 33 to play stored music, and activate the lighting unit 34 to produce lighting effects. The main controller 41 will also activate the electromagnetic generator 15, using sound, light, and rocking of the bed to soothe the infant. The main controller 41 can also connect to a handheld device 5, such as a mobile phone or tablet, through the connection module 46. Thus, when the main controller 41 determines that the infant is in danger, such as having a fever, experiencing hypothermia, or lacking detectable breathing or heartbeat for a certain period, the main controller 41 will not only emit an alarm sound through the sound generator 33, but can also send an alert message to the handheld device 5 via the connection module 46, thereby notifying the infant's caregiver.

After the main controller 41 is connected to the handheld device 5, various settings can be adjusted or functions can be enabled or disabled. For example, it is possible to set the required decibel level of a baby's cry to trigger the aforementioned soothing functions, or adjust the volume of the music played, the brightness of the lighting unit 34, or the intensity of the bed's rocking motion. It is also possible to activate the sound and light effects or the bed rocking function independently. The connection between the connection module 46 and the handheld device 5 can be established via the Bluetooth, or the connection module 46 can connect to a wireless network (Wi-Fi), and then connect to the handheld device 5 through the network. The handheld device 5 must have a dedicated application pre-installed to enable control and communication with the connection module 46. Additionally, when the main controller 41 automatically activates the soothing function, the main controller 41 can also send a notification to the handheld device 5.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A cradle and its intelligent sensing and soothing device, comprising a bed base unit, a movable bed unit, a main unit, and a sensing and control unit;

wherein:

the bed base unit includes a base frame, and two guide rails fixedly mounted on the base frame;

each of the two guide rails has a top recessed with two guide rail sliding grooves;

each of the two guide rail sliding grooves is formed with a concave arc shape with its lowest point at a center thereof;

each of the two guide rail sliding grooves has interior provided with a steel ball;

an electromagnetic generator is fixedly mounted on the base frame;

the movable bed unit includes a bed body, and two sliding sleeves fixedly mounted on a bottom of the bed body;

the two sliding sleeves are mounted on the two guide rails respectively;

multiple bearing seats and a magnet box are fixedly mounted on the bottom of the bed body;

each of the bearing seats has a bottom recessed with a bearing seat sliding groove;

the bearing seat sliding groove rests against the steel ball;

the magnet box is disposed above the electromagnetic generator;

an enclosure is fixedly mounted on the bed body;

the main unit includes a casing fixed to the enclosure;

a camera is pivotally mounted to the casing;

the camera is connected to an adjustment knob;

the adjustment knob corresponds to a rotation axis of the camera;

the casing is provided with a sound generator and a lighting unit;

the sensing and control unit is mounted on the casing and includes a main controller electrically connected to the camera, the sound generator, and the lighting unit;

the main controller is electrically connected to an audio receiver, a body temperature sensing module, a motion sensing module, a cradle connection module, a connection module, and a control button set; and the cradle connection module is electrically connected to the electromagnetic generator.

2. The cradle and its intelligent sensing and soothing device as claimed in claim 1, wherein the body temperature sensing module uses a thermopile infrared sensor.

3. The cradle and its intelligent sensing and soothing device as claimed in claim 1, wherein the motion sensing module uses a millimeter-wave radar sensor.

4. The cradle and its intelligent sensing and soothing device as claimed in claim 1, wherein the casing is recessed with a recessed portion, and the casing rests against the enclosure by the recessed portion.

* * * * *